United States Patent [19]

Cravens

[11] 4,091,926

[45] May 30, 1978

[54] CONTAINER FOR HOLDING FOUR GLASSES IN SPACED RELATION AND BLANK FOR FORMING SAME

[75] Inventor: Harold Cravens, Woodridge, Ill.

[73] Assignee: H. Fishlove & Co., Chicago, Ill.

[21] Appl. No.: 798,499

[22] Filed: May 19, 1977

[51] Int. Cl.[2] ..... B65D 85/44

[52] U.S. Cl. ..... 206/426; 206/188; 229/22; 229/41 C; 229/29 D

[58] Field of Search ..... 229/29 B, 29 C, 29 D, 229/18, 22, 41 C, 41 D; 206/183, 188, 426, 194, 193, 427, 429, 431, 521

[56] References Cited

U.S. PATENT DOCUMENTS

| | | | |
|---|---|---|---|
| 2,685,399 | 8/1954 | Crosby | 229/22 |
| 2,721,001 | 10/1955 | Hasselhoff | 229/28 BC |
| 3,079,062 | 2/1963 | Craddock et al. | 229/22 |
| 3,122,298 | 2/1964 | Seger, Jr. | 229/41 C |
| 3,844,470 | 10/1974 | Rohoe | 229/22 |
| 3,869,079 | 3/1975 | Oglesbee | 229/29 D |
| 3,884,353 | 5/1975 | Forte | 206/429 |

FOREIGN PATENT DOCUMENTS

| | | | |
|---|---|---|---|
| 210,821 | 8/1960 | Austria | 229/22 |

*Primary Examiner*—William Price
*Assistant Examiner*—Bruce H. Bernstein
*Attorney, Agent, or Firm*—Vogel, Dithmar, Stotland, Stratman & Levy

[57] ABSTRACT

A single piece of cardboard stamped to facilitate the folding of same into a container for housing four glasses in spaced relation one from the other. A cardboard blank is disclosed with various fold lines provided therein; a sequenced folding operation produces a container consisting of a double thickness bottom, eight triangularly shaped side walls and a top. Both the top and bottom are provided with four pockets for isolating four glasses one from the other.

28 Claims, 6 Drawing Figures

CONTAINER FOR HOLDING FOUR GLASSES IN SPACED RELATION AND BLANK FOR FORMING SAME

BACKGROUND OF THE INVENTION

Providing a cardboard blank which is foldable to produce a carton for housing glasses is old in the art; however, designing a blank providing, when folded, four bottom pockets and four top pockets, each cooperating with the others to insulate the four housed glasses one from the other has not been previously provided in the compact arrangement disclosed in the present invention. In prior art containers, the glasses have not been adequately held or sufficiently isolated to prevent breakage. The present invention accomplishes both of these ends while maintaining the single piece construction and easy folding required to package large numbers of items.

SUMMARY OF THE INVENTION

A principal object of the present invention is to provide a blank foldable into a carton or container housing four glasses, wherein four individual pockets are provided in the bottom thereof.

Another object of the present invention is to provide a carton and blank for forming same of the type described, wherein four top pockets are provided each in registry with an associated bottom pocket.

Another object of the present invention is to provide a carton and blank for forming same in which cut outs are provided in individual portions of the side walls to allow the product to be displayed for potential purchasers.

A further object of the present invention is to provide a blank for folding into a container holding four glasses, the blank comprising a one-piece construction having fold lines and edges defining: (a) a first set of four triangular shaped members; (b) a second set of four triangular shaped members interleaved with the first set such that the apexes of each set extend toward the bases of the other set; (c) a third set of four generally triangular shaped members each having at least a portion of the base thereof defined by a fold line common to a portion of the base of a respective one of the first set of triangular shaped members with at least one of the outermost members of the third set having a divider extending from the outermost edge thereof; (d) a fourth set of three triangular shaped members interleaved with the third set such that the apexes of each set extend toward the bases of the other set; and (e) a rectangular bottom forming member extending outwardly from the base of at least two of the triangular members in the second set; whereby folding the blank produces an eight sided carton for four glasses having four pockets on the bottom and four pockets on the top thereof.

A still further object of the present invention is to provide a blank of the type set forth in which a fourth set of three triangular shaped members interleaved with the third set is provided such that the apexes of each set extend toward the bases of the other set and the fourth set when folded provide the internal dividers forming the top pockets.

Yet another object of the present invention is to provide a blank for folding into a container holding four glasses, said blank comprising a one-piece construction having fold lines and edges defining: (a) a first set of four triangular shaped members each having a cut out portion with the outermost triangular member in the first set having a first fastening member thereon; (b) a second set of four triangular shaped members interleaved with the first set such that the apexes of each set extend toward the bases of the other set with the outermost triangular member in the second set having a second fastening member thereon; (c) a third set of four generally triangular shaped members each having at least a portion of the base thereof defined by a fold line common to a portion of the base of a respective one of the first set of triangular shaped members with at least one of the outermost members of the third set having a divider extending from the outermost edge thereof; (d) a fourth set of three triangular shaped members interleaved with the third set such that the apexes of each set extend toward the bases of the other set; and (e) a rectangular bottom forming member extending outwardly from the base of each triangular member in the second set with each bottom forming member having slits therein and a fold line generally parallel to the base of the respective one of the triangular members in the second set; whereby folding of the blank produces an eight sided carton for four glasses having four pockets on the bottom with each pocket having a double bottom thickness and upstanding side walls and four pockets on the top thereof each separated by an internal member of the carton formed by the fourth set of members and the divider, the first and second fastening members retaining the folded carton together.

Still another object of the present invention is to provide a carton having a bottom member square in plan view; four triangularly shaped first side walls extending upwardly from the bottom wall and perpendicular thereto, four triangularly shaped second side walls slanting inwardly with each positioned with the apex thereof at a corner of the bottom member, the bases of the second side walls meeting the apexes of the first side walls to form an eight sided carton, a top intersecting the side walls and closing the carton, and upstanding partitions dividing the bottom member into four pockets, each sized to receive an associated glass therein.

A final object of the present invention is to provide a carton of the type set forth, in which the bottom pockets are formed by spaced apart upstanding members extending parallel to one side wall and intersected by spaced apart upstanding members extending perpendicularly to the first pair of upstanding members, thereby forming aisles between adjacent pockets and further comprising downwardly extending divider members forming the top pockets, each of the downwardly extending divider members being in registry with an associated one of the aisles.

These and other objects of the present invention will be more readily understood when considered with the ensuing specification taken in conjunction with the drawings, in which:

DESCRIPTION OF THE PREFERRED EMBODIMENT

Figure 3:
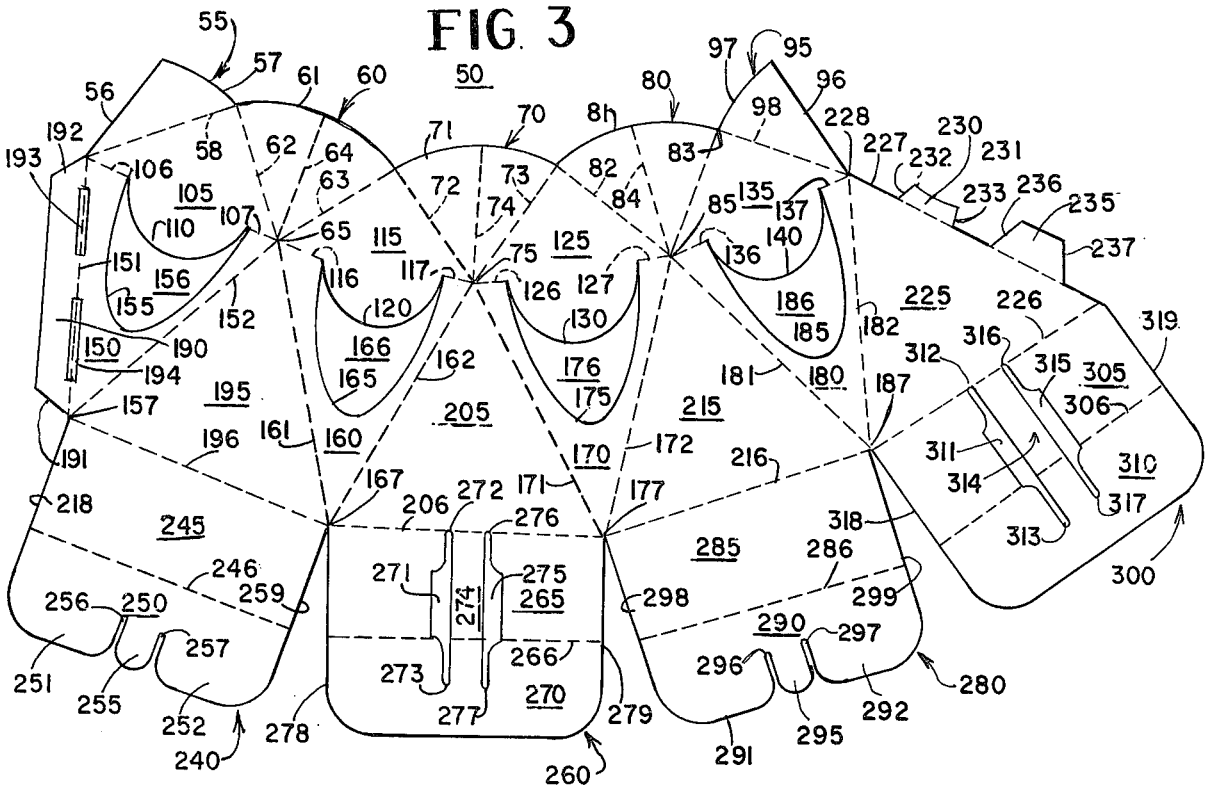
FIG. 3 is a plan view of the blank for forming the carton of the present invention.
Figure 4:
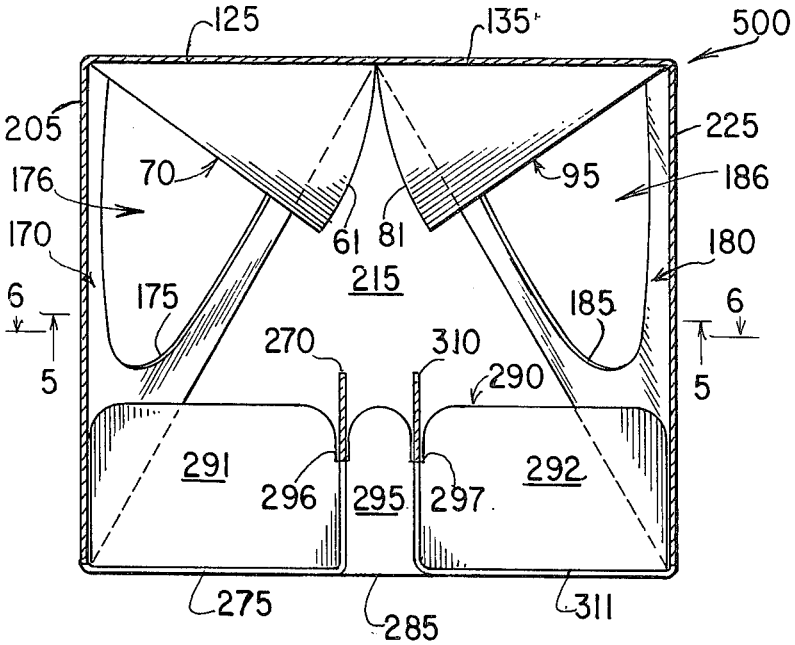
FIG. 4 is a view in section of the carton illustrated in FIG. 1 as seen along the line 4—4 thereof.
Figure 5:
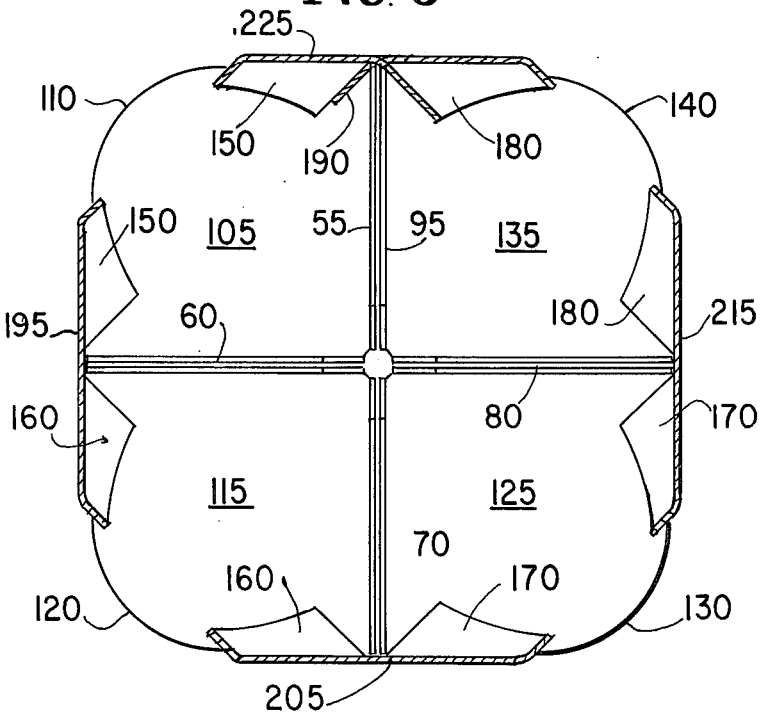
FIG. 5 is a plan view partly in section of the carton illustrated in FIG. 4, viewed in the direction of line 5—5 thereof.
Figure 6:
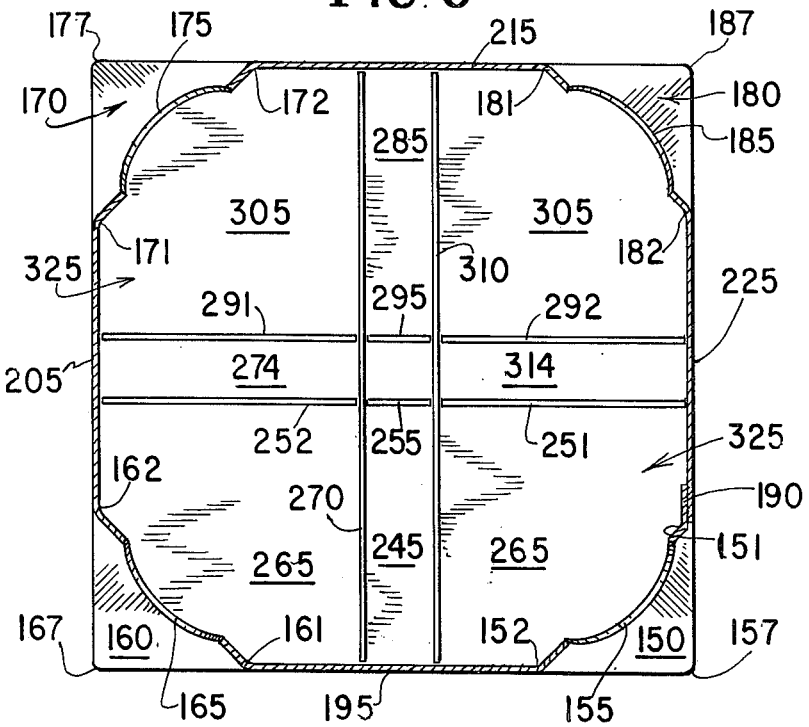
FIG. 6 is a plan view partly in section of the carton illustrated in FIG. 4 as viewed in the direction of line 6—6 thereof.

Referring now to the drawings, there is disclosed a blank 50 in FIG. 3, which when folded, produces the carton 500 illustrated in FIGS. 1, 2 and 4 through 6. The blank 50 is preferably made of cardboard, but may be made of other materials well known in the art. The blank 50 is provided with various perforations or indented fold lines, both perforations and fold lines being treated identically for the present application, since they fundamentally serve the same purpose. The blank 50 is divided into various sets of abutting triangularly shaped members, which when folded provides the eight sided carton 500, as will be more clearly understood.

Referring now to FIG. 3, there is disclosed a blank 50, having four sets of triangular shaped members which include a set comprised of the three triangular shaped divider members 60, 70 and 80, interleaved with a set of four triangular shaped top forming members 105, 115, 125 and 135, the bases of which respectively abut the bases of another set of four triangular shaped display members 150, 160, 170 and 180. Interleaved between the last mentioned set of triangular display members is the last set of triangular shaped side members 195, 205, 215 and 225, with rectangular base forming members 240, 260, 280 and 300, each depending from the base of the aforementioned set of triangular members 195 through 225.

In the upper left-hand corner of FIG. 3, there is a triangular end piece divider 55 having a straight outer edge 56 and an arcuate outer edge 57. The triangular member 55 is closed by the fold line 58 interconnecting the end of the edge 56 and the end of the edge 57. There is another divider member 95 at the upper right-hand corner of the blank 50, the divider member 95 being formed by a straight edge 96, an arcuate edge 97 and an interconnecting fold line 98.

Referring now to the set of triangular shaped divider members 60, 70 and 80, the triangular member 60 has an arcuate edge 61 defining an arc of about 72° or 73° formed by the intersection of the fold lines 62 and 63 at an apex 65. The fold line 64 bisects the included angle between the lines 62 and 63. Similarly, the triangular shaped divider member 70 is formed of the arcuate edge 71 defining an arc of about 72° or 73° formed by the intersection of fold lines 72 and 73 at the apex 75 and has a fold line 74 bisecting the included angle. The triangularly shaped divider member 80 is formed by the arcuate edge 81 defining an arc of about 72° or 73° formed by the intersection of fold lines 82 and 83 at an apex 85 and has a fold line 84 bisecting the included angle.

Both the divider members 55 and 95 each have the arcuate edges 57 and 97 thereof, respectively defining an arc of approximately 37½°. It should be noted that the angular dimensions set forth herein are approximate due to the in exact nature of fold lines on cardboard or the like.

There is provided a set of triangular shaped top forming members 105, 115, 125 and 135. The triangular shaped top forming member 105 is defined by the intersecting fold lines 58 and 62 including an angle of 90° and fold lines 106 and 107 forming a base and each defining an angle of 45° with the adjacent lines 58 or 62. An arcuate edge 110 interconnects the innermost terminal ends of the fold lines 106 and 107, thereby to complete the triangular shaped member top forming 105. The triangular shaped top forming member 115 is defined by the intersecting fold lines 63 and 72 including an angle of 90° therebetween and the base fold lines 116 and 117 each defining an angle of 45° with the adjacent fold line. An arcuate edge 120 connects the inner terminal ends of the fold lines 116 and 117.

The triangular shaped top forming member 125 is defined by the intersecting fold lines 73 and 82 including an angle of 90° therebetween, with the base of the triangular member 125 being defined by the fold lines 126 and 127, each including an angle of 45° with the adjacent side of the triangular member and the arcuate edge 130 interconnecting the inner terminal ends of the fold lines 126 and 127. Finally, the triangular shaped top forming member 135 is defined by the intersecting fold lines 83 and 98 forming a 90° angle therebetween with the base of the member being defined by inwardly extending fold lines 136 and 137 and the arcuate edge 140. The fold lines 136 and 137 respectively include an angle of 45° with the adjacent side fold lines 83 and 98. It will be seen that each of the triangular shaped top forming members 105, 115, 125 and 135, have the bases thereof meeting at the apexes 65, 75 and 85 of the set of triangular shaped divider members 60, 70 and 80.

The blank 50 further includes another set of triangular shaped display members 150, 160, 170 and 180, which form part of the eight side walls of the container 500. The display member 150 is formed by fold lines 151 and 152 intersecting at an apex 157 and defining an angle of about 42° therebetween. The base of the triangular display member 150 is formed by the fold lines 106 and 107 interconnected by the arcuate edge 110. The juncture of the edge 110 and the fold lines 106 and 107 determines the end points of an arcuate edge 155 which is approximately oval in shape and forms a cut out 156. The angle formed between the fold lines 106 and 151 as well as the fold lines 107 and 152 is approximately 69°.

The triangular shaped display member 160 is defined by the fold lines 161 and 162 intersecting at an apex 167 and including an angle of 42° therebetween. The base of the member 160 is defined by the fold lines 116 and 117 and the included arcuate edge 120. The angle between intersecting lines 161 and 116 as well as between lines 162 and 117, is about 69°. The interior terminal ends of lines 116 and 117 determine the end point of an oval shaped edge 165 defining a cut out 166.

The display member 170 is defined by fold lines 171 and 172 meeting at an apex 177 and defining an angle of approximately 42° therebetween. The triangular member 170 is further defined by the fold lines 126 and 127 with the arcuate edge 130 therebetween. An arcuate or oval shaped edge 175 interconnects the inner terminal ends of the fold lines 126 and 127 and provides a cut out area or opening 176. The angle formed by the intersection of fold lines 171 and 126 as well as 172 and 127 is about 69°.

The triangular shaped display member 180 is defined by the fold lines 181 and 182 meeting at an apex 187 and defining an angle of about 42° therebetween. The fold lines 181 and 182 respectively meet the fold lines 136 and 137 and each form an angle of about 69° therebetween. The arcuate edge 140 completes the base of the display member 180 and the arcuate edge 185 defines a cut out area 186, in the same manner previously described.

An end tab or retaining member 190 is integrally connected to the display wall 150 and extends outwardly from the fold line 151 thereof. The retaining member or end tab 190 has sloping side edges 191 and 192. Spaced apart elongated slots 193 and 194 are provided in the retaining member 190 at the fold line 151.

Another set of triangular shaped members 195, 205, 215 and 225 form the upstanding side walls of the container 500. Particularly, the side wall 195 is defined by a base fold line 196 intersecting the fold lines 152 at the apex 157 and forming a 60° angle therewith and intersecting the fold line 161 at the apex 167 and forming a 60° angle therewith. The juncture of the fold lines 152 and 161 is at the apex 65 of the triangular divider member 60, and the included angle formed thereat is 60°. The triangular upstanding side wall 205 is defined by a base fold line 206 intersecting the fold line 162 at the apex 167 and forming a 60° angle therewith, and intersecting the fold line 171 at the apex 177 and forming a 60° angle therewith. The fold lines 162 and 171 intersect at the apex 75 of the divider member 70 and includes an angle of 60° therebetween.

The upstanding triangular side wall 215, is defined by a base fold line 216 intersecting the fold line 172 at the apex 177 forming a 60° angle therebetween and intersecting the fold line 181 at the apex 187 forming an angle of 60° therebetween. The fold lines 172 and 181 intersect at the apex 85 of the divider member 80 and form a 60° angle therebetween. Finally, the upstanding side wall 225, is defined by a base fold line 226 intersecting the fold line 182 at the apex 187 forming a 60° angle therebetween and intersecting the edge 227 forming an angle of 60° therewith. The fold line 182 and the edge 227 meet at a point 228 and form a 60° angle therebetween, the point 228 being the apex of the triangular divider member 95. Spaced apart tabs 230 and 235 are provided and extend outwardly from the side edge 227, the tab 230 having an inwardly extending arcuate edge 231 and slanting edges 232 and 233. The tab 235 is provided with a straight end edge and two inwardly slanting side edges 236 and 237. Both the tabs 230 and 235 are respectively sized to fit within and frictionally engage the slots 193 and 194.

The bottom of the container or carton 500 is formed by four rectangularly shaped base forming members 240, 260, 280 and 300, each having dimensions of about 4½ inches by about 5 13/15 of an inch. It will be appreciated that the bottom forming members 240 and 280, are similar in construction and the bottom forming members 260 and 300 are similar in construction. Referring now to the bottom forming member 240, there is provided an outer bottom panel 245 defined by the fold line 196 and a fold line 246 parallel thereto and spaced therefrom a distance of about 2½ inches. A partition member 250 is integral with the outer bottom panel 245 and includes spaced apart sections 251 and 252 with a tongue 255 therebetween. The tongue 255 is defined by slits having junctions 256 and 257 with the member 250. The bottom forming member 240 is defined by the spaced apart and parallel edges 258 and 259, which join the rest of the blank 50 respectively at the apexes 157 and 167.

The bottom forming member 260 includes an inner bottom panel 265 defined by the fold line 206 and a fold line 266 spaced apart and parallel thereto. The approximate distance between the fold lines 206 and 266, is about 2½ inches. Integral with the inner bottom panel 265, is a partition member 270 having two spaced apart apertures 271 and 275 therein, the apertures 271 and 275 defining a strip 274 therebetween. Each of the apertures 271 and 275 is elongated with the aperture 271 having an end 272 which intersects the fold line 206 and an end 273 which extends into the partition member 270. Similarly, the aperture 275 has an end 276 intersecting the fold line 206 and end 277 extending well into the partition member 270. The bottom forming member 260 is defined by the side edges 278 and 279 respectively meeting the blank 50 at apexes 167 and 177.

The next adjacent bottom forming member 280 includes an outer bottom panel 285 defined by the fold line 216 and the fold line 286 parallel thereto and spaced apart therefrom a distance of about 2½ inches. The partition member 290 extends outwardly from the outer bottom panel 285 a distance of about 2 inches and includes spaced apart sections 291 and 292 with an intermediate tongue 295. The tongue 295 is joined to the partition member 290 at the junctures 296 and 297. The spaced apart parallel side edges 298 and 299 define the bottom forming panel 280 and join the rest of the blank 50 respectively at apexes 177 and 187.

The final bottom forming member 300 includes an inner bottom panel 305 defined by the fold lines 226 and 306 spaced apart and parallel. A partition member 310 extends outwardly from the inner bottom panel 305 and is provided with spaced apart apertures 311 and 315 defining a strip 314 therebetween. The aperture 311 is elongated and has one end thereof 312 intersecting the fold line 226 and the other end 313 extending well into the partition member 310. Similarly, the aperture 315 has one end thereof 316 intersecting the fold line 226 and the other end thereof 317 extending well into the partition member 310. The entire bottom folding member 300 is defined by the side edges 318 and 319 respectively joining the blank 50 at the apex 187 and at the end of the side edge 227 of the member 225.

Folding the blank 50 to provide the one-piece constructed carton 500 will now be described. Referring now to FIG. 3, the first bend or fold to be made is with the divider member 55. All folds are made inwardly out of the plane of FIG. 3, toward the reader, until the bottom forming members 240 to 300 are folded. A similar fold is made with the divider member 95 at the fold line 98. Next, the dividers 60, 70 and 80, are formed as follows. The third fold is along the line 84 and provides the divider 80 consisting of the abutting halves of the member 80. The next or fourth fold, is made along the line 64 to provide the divider 60 and the fifth fold is along the line 74 to provide the divider 70. With the folding along the lines 64, 74 and 84, (although not in that order), creases occur along the lines 106, 107, 116, 117, 126, 127 and 136 and 137.

The next or sixth fold is along the line 151 to provide the tab 190 and simultaneously open the slots 193 and 194. Thereafter, folds seven through thirteen, are made sequentially along lines 152, 161, 162, 171, 172, 181 and 182 thereby to form the upstanding sides 195, 205, 215 and 225 as well as the display members 150, 160, 170 and 180 of the carton 500. Thereafter, the fourteenth and fifteenth folds are for the tabs 230 and 235 at the junctures with the side forming member 225. The tabs 230 and 235 are inserted into the corresponding slots 193 and 194, respectively. At this juncture, the top of the carton 500 and the sides have been formed with 15 folds.

Thereafter, the carton 500 may be positioned with the top down and the glasses (not shown) inserted.

Figure 1:
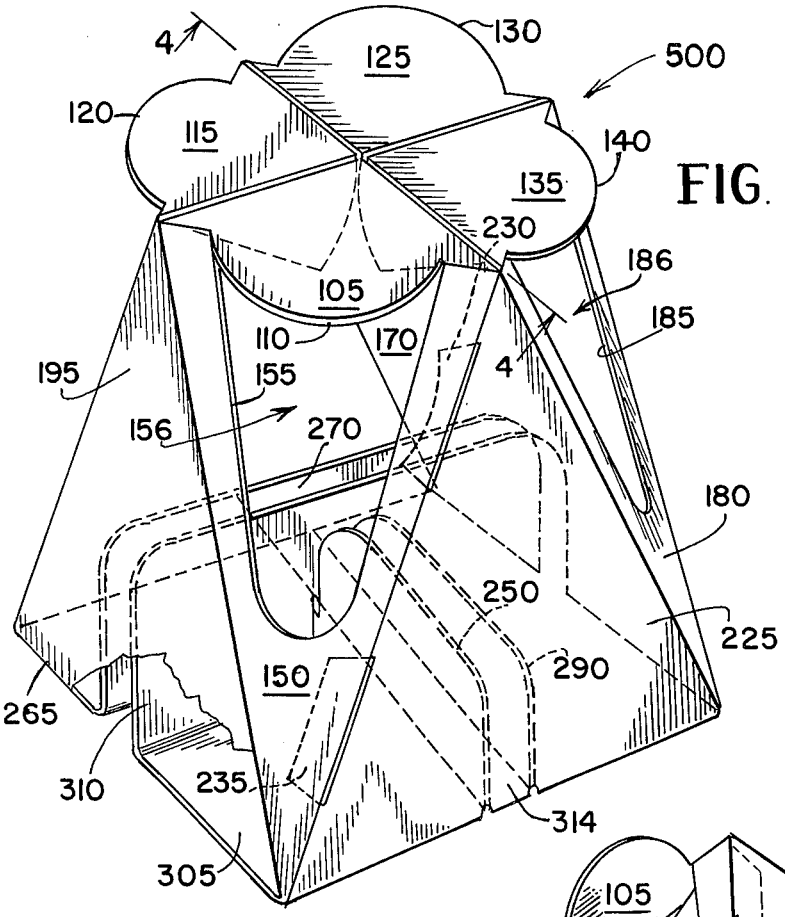
FIG. 1 is a perspective view of the folded blank forming a carton illustrating the present invention.
Figure 2:
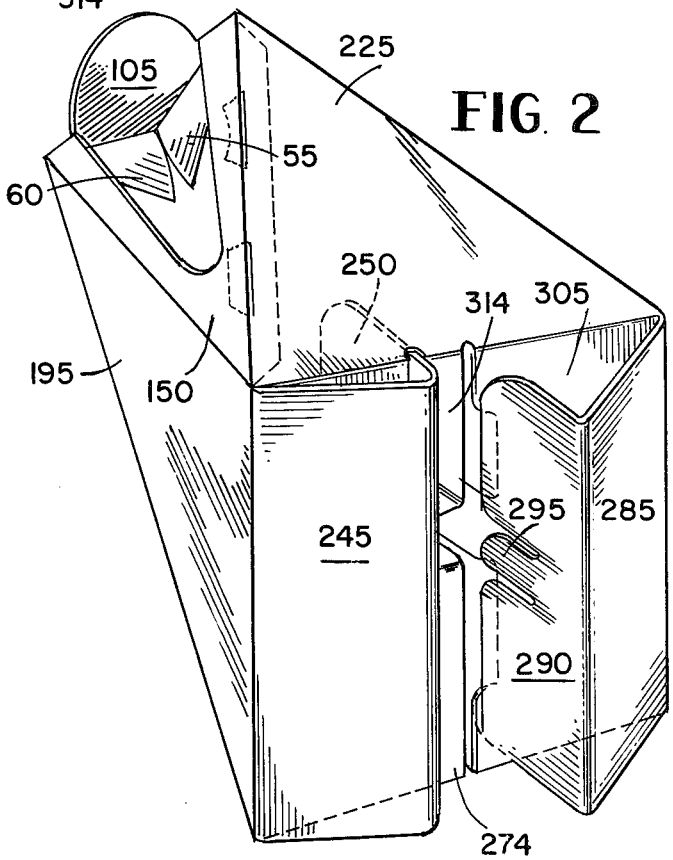
FIG. 2 is the carton illustrated in FIG. 1, tilted on its side particularly illustrating the folding relationship of the bottom forming members.

At this stage, the upstanding perpendicular side walls 195, 205, 215 and 225, are in the position shown in FIG. 1, with the inwardly slanting triangular shaped display walls 150, 160, 170 and 180 as shown. The top of the carton 500 is formed by the combination of the four top forming members 105, 115, 125 and 135 and the divider members are in position, these being members 60, 70 and 80 folded as previously described and the abutting end dividers 55 and 95.

After the glasses have been inserted into the partially formed carton 500, the bottom is formed by folding the bottom forming members 240, 260, 280 and 300. The first member folded is member 300. The 16th fold is along line 226 and then along line 306, the 16th fold providing the inner bottom panel 305 parallel to the top forming members 105 and 135 and the 17th fold along line 306 providing the partition member 310 perpendicular to the bottom member 305. The 18th fold is with the bottom forming member 260 and occurs along the line 206 to provide the inner bottom panel 265 in the same plane as the panel 305 and the 19th fold is along the line 226 to provide the partition 270 perpendicular to the panel 265 and parallel to the partition 310.

The 20th folding operation, is with the bottom forming member 240 and is along the fold line 196 and the next folding operation is along the line 246, to provide the partition member 250. The partition member 250 is folded such that the section 251 is inserted through the slit 315 and the section 252 is inserted into the slit 271 with the tongue 255 separating the partitions 270 and 310. Similarly, the 22nd and 3rd folding operations are with the bottom forming member 280, which is folded such that the panel 285 forms the outer portion of the bottom and the section 292 fits into the slit 311 and the section 291 fits into the slit 275 with the tongue 295 separating the partitions 270 and 310.

As most clearly seen from FIG. 1, the bottom folding members 240, 260, 280 and 300, combine to form the four bottom pockets 325 (see FIG. 6), wherein each pocket 325 is separated from the adjacent pockets by means of spaced apart upstanding partition members 250, 270, 280 and 310. Specifically, the partition members 270 and 310 are spaced apart and parallel and are intersected by the spaced apart and parallel partition members 250 and 290, thereby to form the four pockets 325. Each of the pockets 325, accordingly, is separated by a distance equal to the strips 274 and 314 and are also equal to the width of the tongues 255 and 295.

Because the bottom forming members 240 and 280 form the outside of the container 500 and bottom forming members 260 and 300 form the inside of the bottom of the container 500, the partitions 250 and 290 are lower than the partitions 270 and 310 in the constructed condition. The carton 500 is maintained in the constructed position by not only the cooperation of the tabs 230 and 235 with the slots 193 and 194, but also the interlocking of the partition members 250 and 290 with the slits 271, 275, 311 and 315. Specifically, in the fully constructed position, the end 277 of the slit 275, engages the juncture 296 and the end 313 of the slit 311 engages the juncture 297. Similarly, the end 317 of the slit 315 engages the juncture 256 and 273 of the slit 271 engages the juncture 257. In this manner, the container 500 is held in the assembled position.

In the assembled position, four pockets are formed in the top of the carton 500 by the dividers 60, 70 and 80, and the divider formed by the combination of the members 55 and 95. Each of these dividers is positioned in registry with one of the aisles formed by the intersection of the members 270 and 310 and the members 250 and 290, see FIGS. 5 and 6. This configuration provides excellent insulation and protection for glasses in the carton 500, since each glass is totally isolated from adjacent glasses. Another feature of the present invention is the positioning of the display walls 150, 160, 170 and 180, with the associated cut outs 156, 166, 176 and 186, thereby enabling the purchaser to inspect the merchandise housed in the container 500 without removing same. This is an important feature, since novelty merchandise as well as other types of glasses may be displayed for the eventual purchaser to see while at the same time protected from brekadage during shipment.

Another feature of the present invention is the arcuate extent and nature of the edges 110, 120, 130 and 140, of the top forming members 105, 115, 125 and 135, which fully protect the top of the glasses from being chipped or otherwise broken.

It will be appreciated therefore, that a carton 500 has been provided square in bottom plan view and with eight side walls, four of which in the constructed position are perpendicular to the bottom and four of which are angularly disposed inwardly with respect to the perpendicular side walls. The carton 500 is closed by a top which provides four pockets for housing four glasses, each pocket being in registry with a corresponding pocket formed by the bottom. The bottom of the carton 500 has a double thickness to insulate and provide strength. Four partitions cooperate to maintain separate each of the glasses from each other and to form discrete pockets 325 in the bottom. The blank 50 is one-piece and may be constructed of any acceptable material although cardboard is preferred.

While there has been described herein what is at present considered to be the preferred embodiment of the present invention, it will be understood that various modifications and alterations may be made therein without departing from the true spirit and scope of the present invention. For instance, the angles and dimensions of the blank 50 which have been set forth herein, are by way of illustration only and are not intended to limit the scope of this invention.

What is claimed is:

1. A blank for folding into a container holding four glasses, said blank comprising a one-piece construction having fold lines and edges defining: (a) a first set of four triangularly shaped display members; (b) a second set of four triangularly shaped side members interleaved with said first set such that the apexes of each set extend toward the bases of the other set with the bases of said second set not being co-linear; (c) a third set of four generally triangularly shaped top forming members each having at least a portion of the base thereof defined by a fold line common to a portion of the base of a respective one of the first set of triangularly shaped display members with both of the outermost members of the third set having a divider extending from the outermost edge thereof; (d) a fourth set of only three triangularly shaped divider members interleaved with the third set such that the apexes of each set extend toward the bases of the other set, (e) rectangular bottom forming members extending outwardly from the base of at least two of the triangularly shaped side members in the second set and means connected with said bottom forming members providing an intersecting folded construction thereof; whereby folding the blank produces an eight sided carton for four glasses having four pockets on the bottom and four pockets on the top thereof.

2. The blank set forth in claim 1, wherein at least one side of adjacent members in the first and second set abut and are coextensive with each other.

3. The blank set forth in claim 1, wherein the side edges of adjacent members of the third set abut when the blank is folded to provide the container top.

4. The blank set forth in claim 1, wherein the bases of each member of the second set of members are substantially the same length to provide a container bottom square in plan view.

5. The blank set forth in claim 1, wherein the apex of each member of the fourth set abuts a corresponding apex of a member of the second set, and upon folding defines the four pockets on the container top.

6. A blank for folding into a container holding four glasses, said blank comprising a one-piece construction having fold lines and edges defining: (a) a first set of four triangularly shaped display members each having a cut out portion therein; (b) a second set of four triangularly shaped side members interleaved with said first set such that the apexes of each set extend toward the bases of the other set; (c) a third set of four generally triangular shaped top forming members each having at least a portion of the base thereof defined by a fold line common to a portion of the base of a respective one of the first set of triangularly shaped members and another portion of the base thereof extending into the cut out of the corresponding display members of the first set; and (d) a rectangular bottom forming member extending outwardly from the base of each triangularly shaped side member in the second set with each bottom forming member having a slit therein; whereby folding the blank produces an eight sided carton for four glasses having four pockets on the bottom each having upstanding side walls for retaining a glass therein, the glasses extending through the cut out portion of the associated triangularly shaped display member of the first set.

7. The blank set forth in claim 6, wherein the cut out portion of each of the first set of members is oval.

8. The blank set forth in claim 6, wherein the portion of the base of each top forming member in the third set extending into the corresponding display member is circular.

9. A blank for folding into a container holding four glasses, said blank comprising a one-piece construction having fold lines and edges defining: (a) a first set of four triangularly shaped display members each having a cut out portion with the outermost triangularly shaped display member in the first set having a first fastening member thereon; (b) a second set of four triangularly shaped side members interleaved with said first set such that the apexes of each set extend toward the bases of the other set with the outermost triangular member in the second set having a second fastening member thereon with the bases of said second set not being co-linear; (c) a third set of four generally triangularly shaped top forming members each having at least a portion of the base thereof defined by a fold line common to a portion of the base of a respective one of the first set of triangularly shaped display members with both of the outermost members of the third set having a divider extending from the outermost edge thereof; (d) a fourth set of only three triangularly shaped divider members interleaved with the third set such that the apexes of each set extend toward the bases of the other set; and (e) a rectangular bottom forming member extending outwardly from the base of each triangularly side member in the second set with each bottom forming member having slits therein and a fold line generally parallel to the base of the associated member in the second set; whereby folding of the blank produces an eight sided container for four glasses having four pockets on the bottom, each pocket having a double bottom thickness and upstanding side walls and four pockets on the top thereof each separated by an internal member of the carton formed by the fourth set of members and the divider, the first and second fastening members retaining the folded carton together.

10. The blank set forth in claim 9, wherein both outermost members of the third set have dividers extending therefrom.

11. The blank set forth in claim 9, wherein the first fastening member is provided with slots and the second fastening member is provided with a corresponding number of tabs constructed and arranged to fit into the slots.

12. The blank set forth in claim 9, wherein alternate ones of the bottom forming members form the inner layer of the bottom and the others of the bottom forming members form the outer layers.

13. The blank set forth in claim 9, wherein each bottom pocket has a double thickness bottom wall, two upstanding side walls at right angles formed by the bottom forming members and an inwardly slanting wall formed by one of the triangular shaped display members having a cut out therein.

14. The blank set forth in claim 9, wherein each top pocket includes a top forming member and two partitions extending downwardly from the side edges thereof formed by members of the fourth set or the divider.

15. The blank set forth in claim 9, wherein the apexes of each top forming member meet centrally of the top.

16. A one-piece, eight sided carton having a bottom square in plan view; four triangularly shaped first side walls extending upwardly from the bottom and perpendicular thereto, four triangularly shaped second side walls slanting inwardly each positioned with the apex thereof at a corner of the bottom member, the side edges of the second side walls meeting the side edges of the first side walls to form the eight sided carton, a top formed of four separate triangular members each extending from the base of the associated second side wall closing the carton, and upstanding partitions dividing the bottom member into four pockets, each sized to receive an associated glass therein.

17. The carton set forth in claim 16, wherein each of the second triangularly shaped side walls has an arcuate cut out therein to permit stored glass to extend therethrough.

18. The carton set forth in claim 16, wherein each pocket is spaced from an adjacent pocket to isolate the glass housed therein.

19. The carton set forth in claim 16, wherein the bottom of each pocket has a double layer.

20. The carton set forth in claim 16, wherein the first side walls form an equilateral triangle.

21. The carton set forth in claim 16, wherein the included angle at the apex of the second side walls is about 42°.

22. The carton set forth in claim 16, wherein the top is a combination of four isosceles triangles.

23. A carton having a bottom square in plan view, four triangularly shaped first side walls extending upwardly from the bottom and perpendicular thereto, four triangularly shaped second side walls slanting inwardly each positioned with the apex thereof at a corner of the bottom member, the side edges of the second side walls meeting the side edges of the first side walls to form an eight sided container, a top closing the container having four dividers integral therewith extending downwardly therefrom forming four discrete pockets, the bottom having four intersecting partitions integral therewith extending upwardly therefrom forming four discrete pockets separated by a cruciform shaped aisleway therebetween, the dividers extending downwardly from the top being in registry with the aisleway.

24. The carton set forth in claim 23, wherein each second side wall has an arcuate aperture therein through which the glasses can be viewed.

25. The carton set forth in claim 23, wherein the top is a combination of four isosceles triangles each having a circular segment extending outwardly from the base thereof sufficiently to overlie the top of the housed glass.

26. The carton set forth in claim 25, wherein each isosceles triangle is a right isosceles triangle with the intersections of the sides defining the right angles of each triangle meeting centrally of the top.

27. The carton set forth in claim 23, wherein the bottom pockets have a double layer of material supporting the glasses.

28. The carton set forth in claim 23, wherein two intersecting partitions of the bottom pass through the other partitions to maintain the carton shape.

* * * * *